US005913268A

United States Patent [19]

Jackson et al.

[11] Patent Number: 5,913,268

[45] Date of Patent: Jun. 22, 1999

[54] PNEUMATIC ROLLERS AND PAPER HANDLING ARRANGEMENTS

[75] Inventors: Warren B. Jackson, San Francisco; David K. Biegelsen, Portola Valley; Lars-Erik Swartz, Sunny Vale, all of Calif.

[73] Assignee: Xerox Corporation, Stamford, Conn.

[21] Appl. No.: 09/024,949

[22] Filed: Feb. 17, 1998

[51] Int. Cl.[6] ..... B41F 1/28

[52] U.S. Cl. ..... 101/420; 101/232; 271/185; 271/195; 271/276

[58] Field of Search ..... 101/232, 418–420, 101/422, 424.1; 271/276, 195, 196, 185, 186

[56] References Cited

U.S. PATENT DOCUMENTS

| | | | |
|---|---|---|---|
| Re. 32,541 | 11/1987 | Stange et al. | 271/3 |
| 3,941,374 | 3/1976 | Vits | 271/183 |
| 4,062,538 | 12/1977 | Stange et al. | 271/243 |
| 4,145,040 | 3/1979 | Huber | 271/276 |
| 4,207,998 | 6/1980 | Schmid | 226/95 |
| 4,440,388 | 4/1984 | Divoux et al. | 271/195 |
| 4,466,605 | 8/1984 | Leuthold et al. | 271/177 |
| 4,493,548 | 1/1985 | Ateya | 355/3 FU |
| 4,543,160 | 9/1985 | Kerttula et al. | 162/193 |
| 4,552,069 | 11/1985 | Jahn | 101/420 |
| 4,726,502 | 2/1988 | Cryderman | 226/97 |
| 4,792,249 | 12/1988 | Lahr | 400/578 |
| 4,997,178 | 3/1991 | Ogoda | 271/276 |
| 5,029,835 | 7/1991 | Blaser et al. | 271/98 |
| 5,032,875 | 7/1991 | Gooray et al. | 355/290 |
| 5,127,329 | 7/1992 | DeMoore et al. | 101/420 |
| 5,197,812 | 3/1993 | Worley et al. | 400/635 |
| 5,299,411 | 4/1994 | Yamamoto et al. | 53/465 |
| 5,402,721 | 4/1995 | Schultz | 101/389.1 |
| 5,411,245 | 5/1995 | Springer et al. | 270/20.1 |
| 5,431,384 | 7/1995 | Obermiller et al. | 271/11 |
| 5,564,692 | 10/1996 | Lotsch et al. | 271/195 |
| 5,626,075 | 5/1997 | Detmers et al. | 101/232 |
| 5,816,155 | 10/1998 | Stephan | 101/232 |

*Primary Examiner*—Edgar Burr
*Assistant Examiner*—Dave A. Ghatz
*Attorney, Agent, or Firm*—Fay, Sharpe, Beall, Fagan, Minnich & McKee, LLP

[57] ABSTRACT

A roller assembly is provided with openings in its outer surface for selective communication with a source of vacuum or a positive pressure. The openings may be angled along the roller rotational axis to impart a component of velocity to the paper perpendicular to the tangential roller surface velocity. Additionally, by selectively connecting the openings with sources of pressure and vacuum, enhanced paper alignment is achieved, multiple paper feeds eliminated, transitions between different velocities of rollers completed, or paper reverted so that printing can be achieved on first and second sides thereof.

12 Claims, 4 Drawing Sheets

PNEUMATIC ROLLERS AND PAPER HANDLING ARRANGEMENTS

BACKGROUND OF THE INVENTION

This application is directed to sheet or paper handling apparatus, particularly rollers for orienting paper in a printing apparatus such as a photocopier, printer, or the like. More particularly, this application is directed to using one or more pneumatic rollers having openings through which air can either be expelled or drawn, i.e., pressure or vacuum, to direct and handle the paper. The invention will be described with reference to a printing apparatus, however, it will be appreciated that the invention has broader applications and may be advantageously employed in other related environments and applications.

In conventional printing apparatus, sheet material or paper is handled by a series of rollers and counter rollers. A counter roller is required to generate forces normal to the tangential surface of a roller for handling the sheet. Counter rollers, unfortunately, lead to jams, paper tears, wrinkling, or other surface damage to the sheet. Aside from the undesired physical damage to the paper, it also requires service or maintenance and additional space is needed to allow access by service personnel to eliminate the jams.

Paper handling also typically requires a component of motion perpendicular to the direction of the roller motion, for example for paper registration. This cannot be accomplished with a standard set of rollers (a roller and counter roller). Instead, an additional set of rollers is required that release and grab the sheet. This unnecessarily adds to the cost, complexity, and the length of the paper path. Moreover, all this complexity is ultimately less reliable and at odds with the goal of reducing the space required to handle the paper.

Still another concern with paper handling in a printing apparatus is the ability to transition between different rates of speed in the paper path. As will be appreciated, in known printing apparatus a sheet of paper undergoes numerous velocity accelerations and decelerations as it passes through the processing path. For example, a paper sheet proceeds from a stationary position at the supply, is increased in velocity to a first workstation, is decelerated at the first workstation, subsequently accelerated to a downstream or second workstation, decelerated at the second workstation, etc. Individual handling and increased processing are goals that require the paper sheets to be spaced apart as far as possible.

On the other hand, increasing the spacing necessarily increases the velocity transitions of the paper. This, in turn, requires the rollers to continuously accelerate and decelerate to perform the velocity transitions or paper bending. The forces associated with the acceleration and deceleration place great stress on the roller and the associated motor systems. Additionally, the increased acceleration and deceleration require still further space in the assembly.

The general use of air in either a pressure or vacuum arrangement associated with a roller assembly is known in the art. By way of example, U.S. Pat. Nos. 4,493,548; Re. 32,541; 4,062,538; 4,543,160; 4,726,502; 4,792,249; 4,997,178; 5,032,875; 5,127,329; 5,197,812; 5,401,721; 5,431,384; 5,299,411; and 5,411,245 are representative prior art patents that generally relate to roller assemblies. These known arrangements, however, have not adequately addressed system demands for increased speed of processing, space constraints, handling different paper stock, and varying rates of speed in the paper path.

SUMMARY OF THE INVENTION

The present invention contemplates a new and improved apparatus and process that overcomes all of these problems and provides a simple, accurate, and compact assembly for handling flexible sheet material such as paper.

According to the invention, there is provided a roller assembly having a roller with a plenum that communicates with an air source. The roller includes openings in an external surface oriented to impart a velocity component to a sheet material in a direction perpendicular to a tangential direction of rotation of the external surface.

According to another aspect of the invention, the plenum is in selective communication with a vacuum source and a source of pressure for urging the sheet material toward and away from the roller surface, respectively.

According to yet another aspect of the invention, the assembly includes first and second rollers rotating at different velocities and the vacuum and pressure sources are used to facilitate a smooth transfer of the sheet material between the rollers rotating at different speeds.

According to still another aspect of the invention, the roller assembly is used for paper reversion by selectively connecting the openings to the vacuum source for urging a first face of the sheet material against the roller, inverting the sheet material through approximately 180 degrees as the roller rotates, then connecting the openings to the pressure source to separate the inverted sheet material from the rotating roller. Subsequently the openings in the roller are connected to the vacuum source to urge a second face of the sheet material against the roller.

A principal advantage of the invention is the elimination of a counter roller to exert a normal force to the sheet material, thus minimizing paper jams and simplifying the machine design.

Yet another advantage of the invention resides in the ability to produce paper motion in a direction perpendicular to the roller motion direction with a single roller.

Still another advantage of the invention resides in the ability to vary the normal force exerted on the paper by simply varying the pressure.

Another advantage of the invention is associated with reducing friction and drag while also enabling slippage or clutch action of the roller with respect to the paper.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts. The preferred embodiments will be described in detail in this specification and illustrated in the accompanying drawings, wherein.

DETAILED DESCRIPTION OF THE PREFERRED EMBODIMENTS

Figure 1:
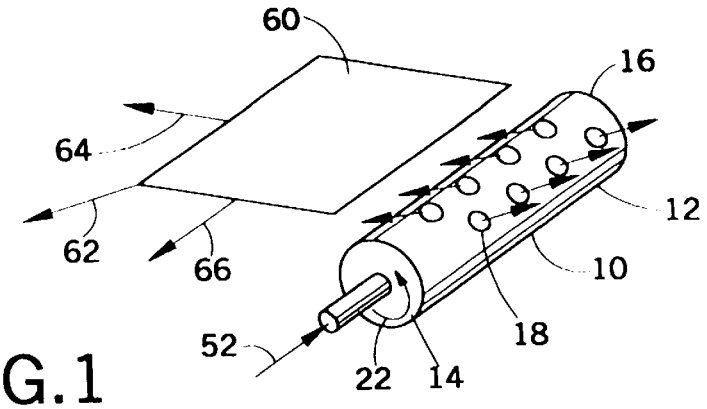
FIG. 1 is a perspective view of a roller handling a sheet of paper in accordance with the teachings of the present invention.

Turning first to FIG. 1, a pneumatic roller assembly formed in accordance with the invention is shown. It includes a roller assembly 10 defined by a generally cylindrical sidewall 12 and opposed end walls 14, 16. The external surface or sidewall 12 has a series of openings 18 at predetermined locations. The openings communicate with a hollow interior or plenum 20 (FIGS. 2 and 3) so that the openings selectively communicate with a source of fluid pressure, either a positive pressure or a vacuum or negative pressure.

Figure 3:
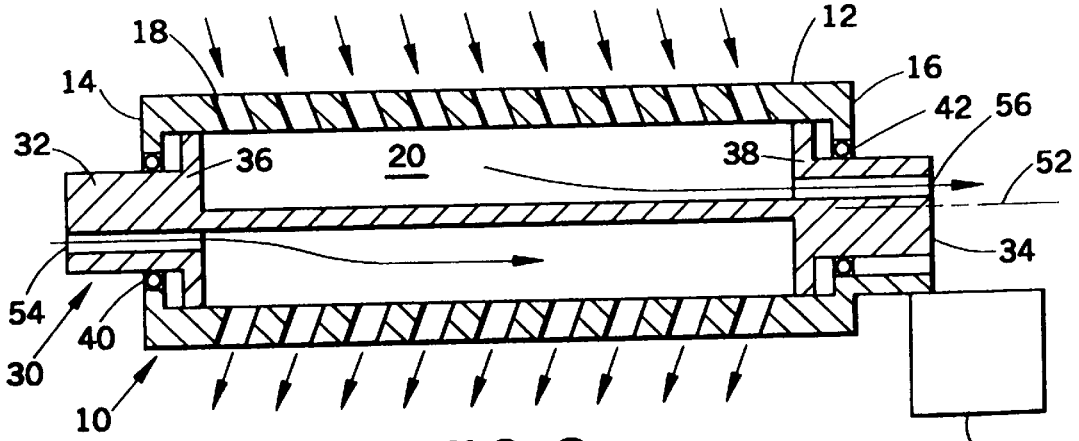
FIG. 3 is a cross-sectional view taken generally along the lines 3—3 of FIG. 2.

As represented in FIG. 1, the roller assembly is adapted for rotation, for example in a counterclockwise direction, as represented by arrow 22. In this particular embodiment, the cylindrical roller has a rotating external portion and a fixed interior portion 30. For example as shown in FIG. 3, axial end portions 32, 34 include enlarged radial shoulders 36, 38 that are received in the rotating external portion 12 and close the opposite ends of the plenum 20. Preferably, the shoulders are received axially inward of end walls 14, 16 of the rotating outer portion and provide a close fitting but freely rotatable assembly. Bearing assemblies 40, 42 are provided at opposite ends and interposed between the stationary inner portion and the rotating external portion of the roller. The roller bearings 40, 42 reduce friction between the relatively rotating outer cylindrical portion and the stationary interior portion. A drive means, such as a direct drive motor 50, is used to rotate the outer cylinder. Alternatively the drive means may comprise belts, gears, etc. that rotate the assembly about a longitudinal axis represented by numeral 52.

Figure 2:
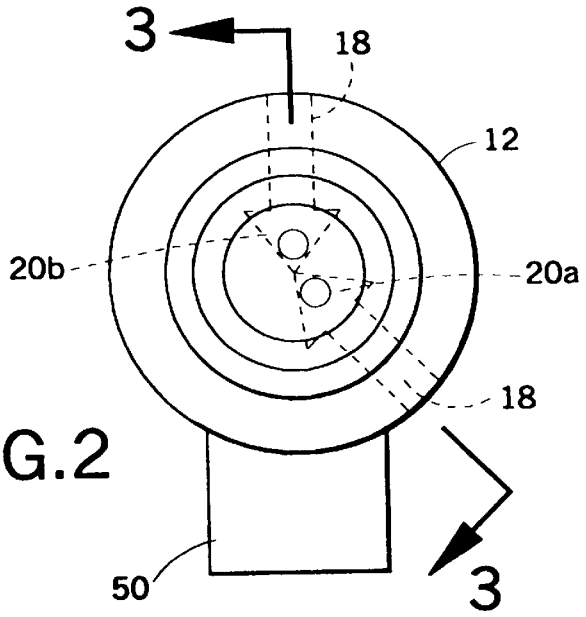
FIG. 2 is an end view of a pneumatic roller having a fixed interior.

The interior cavity or plenum 20 communicates with an external source of positive or negative pressure (not shown) via one or more passages 54, 56 extending through the end portions 32, 34. It will also be understood that passages other than those illustrated can be provided for establishing communication between the plenum and the air source. The openings 18 in the rotating cylinder need not be in constant communication with the air source but may selectively communicate with either positive pressure or vacuum. Thus, as illustrated in FIG. 2, the openings 18 in the outer cylinder selectively communicate with a pair of chambers 20*a*, 20*b* defined in the stationary interior portion. The circumferential location of the external surface of the cylinder determines when the openings communicate with the plenum. Moreover, the rotational speed of the external portion determines the length of time with which the openings are supplied with pressure/vacuum. Thus, through one portion of the rotation, the openings may be supplied with pressure or vacuum while in selected other portions of the rotation, they may not.

As perhaps best exemplified in FIG. 3, the openings 18 are preferably oriented at a preselected angle relative to the external surface. Each of the openings 18 angles toward the first axial end (left end of FIG. 2) although it will be appreciated that selective openings may be oriented in other directions also. This angular orientation imparts an axial component to a paper sheet as it traverses the roller. Providing an axial component to the air effectively directs a sheet of paper 60 in a desired direction. As illustrated by the arrows extending from the openings in FIG. 1, the paper sheet is imparted with a resultant velocity represented by arrow 62 which comprises components that extend in a tangential direction 64 (tangential to the roller rotation) and in an axial direction 66 (parallel to the rotational axis of the roller). Orienting the openings in this fashion allows the paper motion to be redirected as the paper passes the roller. As indicated above, prior conventional roller assemblies require a complex set of rollers that release and grab the paper to achieve movement in a direction parallel to the axis of rotation of the roller. The subject invention, however, provides an effective and simple assembly to achieve this movement.

Alternatively, air supplied through the openings forms an air bearing to support the paper without directly contacting it. As discussed above, by orienting the openings to have an axial component, the air imparts a component of velocity to the paper perpendicular to the tangential roller surface velocity. This motion is not possible with traditional roller/counter roller systems, at least without damaging the paper's surface.

It will be understood from a review of FIG. 3 that the impedance to airflow between the stationary interior portions and the rotating outer portions of the roller assembly must be greater between the fixed and rotating components than the impedance offered by the openings 18. Moreover, various applications of the roller assembly are obtained by applying multiple positive and negative, time-bearing pressures to the roller plenum to effect desired paper motions. For example, the plenum is connected to vacuum during a portion of the roller rotation to draw the paper to the roller. This results in the paper being drawn toward the roller surface and its velocity matching the tangential roller velocity of the rotating exterior portion. This control of the paper velocity is also achieved without the need for a counter roller as in prior arrangements. Moreover, varying the suction or negative pressure results in a continued variation of the normal force. Likewise, applying a positive pressure to the openings during selected time varying stages directs the paper in the desired sequence.

Turning to FIGS. 4A–D, a particular application of these principles of paper handling will be illustrated. Here, paper registration is enhanced by using only a few rollers instead of a large number of rollers as required in prior arrangements to achieve this movement of the paper sheet. Additionally, this arrangement allows lighter paper stocks to be used when compared to prior art arrangements.

Figure 4A:
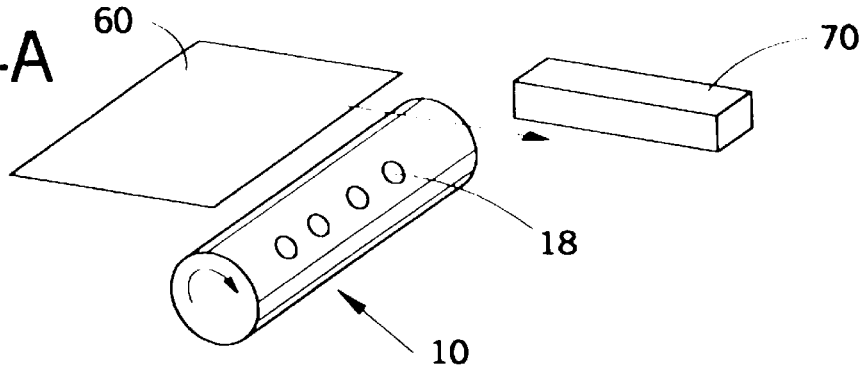
FIGS. 4A–4D are a schematic representation of the selective use of vacuum and pressure to guide a paper sheet.
Figure 4B:
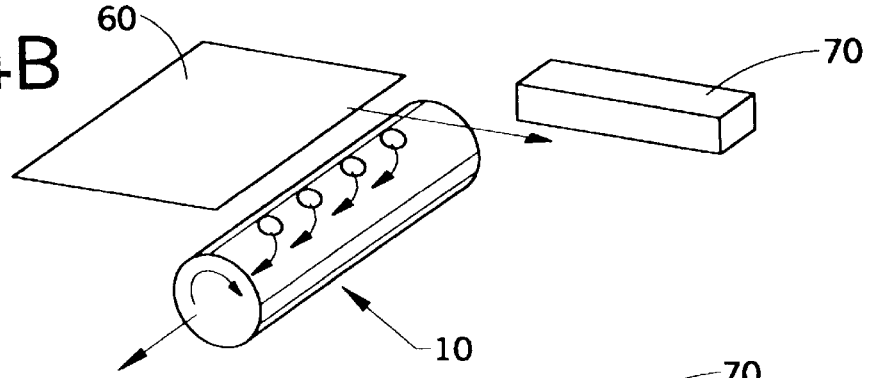
Figure 4C:
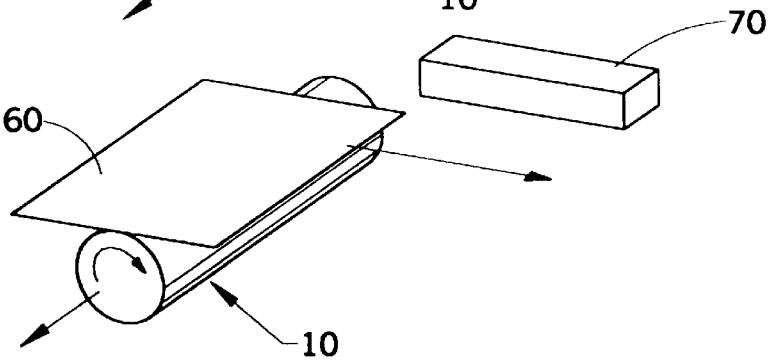
Figure 4D:
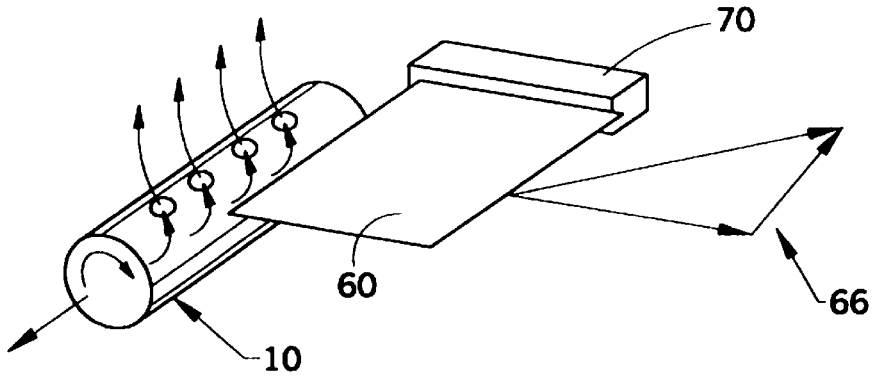

As shown in FIG. 4A, sheet 60 approaches the rotating roller assembly 10. Preferably, air is blown outwardly from the roller openings to contact the paper and allow the paper to move at a different velocity relative to the roller. Once the paper is more fully situated over the roller, the openings 18 then communicate with a vacuum, thereby drawing the paper onto the roller surface. As detailed above, the paper then transitions to the velocity of the roller. The vacuum continues to be applied as the paper proceeds rightwardly as shown in FIG. 4C at the speed of rotation of the roller. As the paper separates from the roller as shown in FIG. 4D, momentum is imparted to the paper by switching the openings 18 to communicate with a positive pressure source. Again, a transition in velocity is achieved. Moreover, if desired, by orienting the openings at this stage to have an axial component 66 perpendicular to the tangential rotation of the roller, the paper sheet can be urged against a guide 70.

Figure 5:
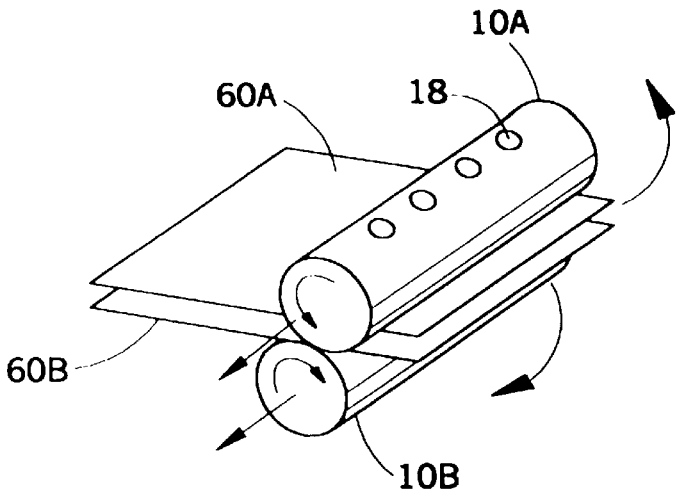
FIG. 5 illustrates the use of a pair of rollers that apply opposing normal forces to a pair of paper sheets to separate the sheets from one another.

As previously indicated, misfeeds are a common problem associated with conventional roller assemblies. Using a pair of rollers each communicating with a source of vacuum enhances the separating action between adjacent sheets (FIG. 5). For example, adjacent sheets 60A, 60B are fed between a gap between counter rotating rollers 10A, 10B. Since each roller includes a series of openings 18 in the external surface that communicate with a source of vacuum, each respective sheet of paper is drawn toward its associated roller thereby enhancing the separating action. This reduces the potential that multiple sheets of paper would be passed downstream, a more common problem associated with counter rollers in a typical paper handling configuration.

Figure 6A:
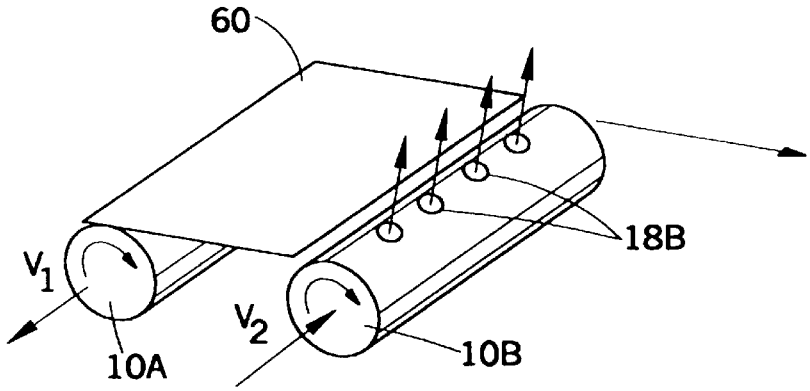
FIG. 6A and 6B schematically represent the selective use of vacuum and pressure with a pair of rollers to provide velocity transitions.
Figure 6B:
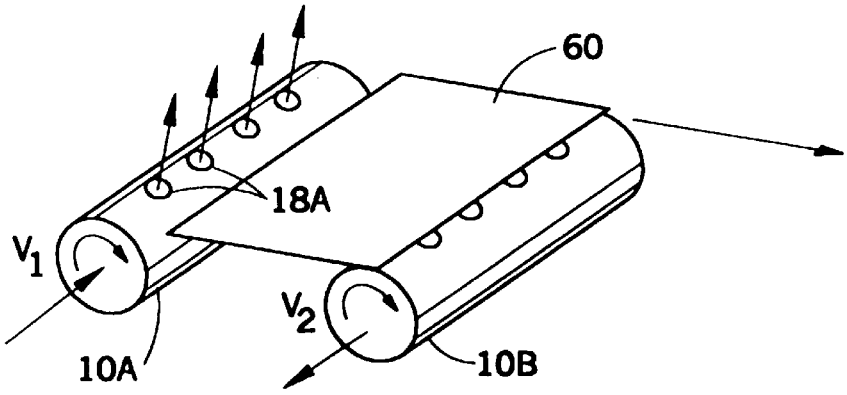

FIGS. 6A and B illustrate still another application of the present invention. These two figures represent velocity transition that can be easily accomplished with roller assemblies of this type. For example, a first or left-hand roller 10A is rotating at a velocity $V_1$. When the upstream roller 10A is in communication with the vacuum source, the paper sheet 60 has the same velocity as the first roller. As the paper proceeds downstream, its leading edge approaches a second or downstream roller 10B. By applying a positive pressure to the second roller, which has a velocity $V_2$, an air bearing is created so that the leading edge of the paper sheet easily transitions over the surface of the second roller. The positive pressure provided to the second roller is then changed to a source of vacuum once the trailing edge of the sheet 60 has left the first roller. This draws the paper sheet toward the second roller allowing it to assume the velocity $V_2$ of the second roller. Moreover, the positive pressure now applied to the first roller assures that the paper is not exposed to two simultaneous, different forces at the leading and trailing edges thereof. For example, positive pressure from the first roller provides additional momentum to the paper as it is drawn toward the surface of the second roller. This eliminates slippage between the paper and the roller, a problem associated with damage to the paper's surface.

Figure 7:
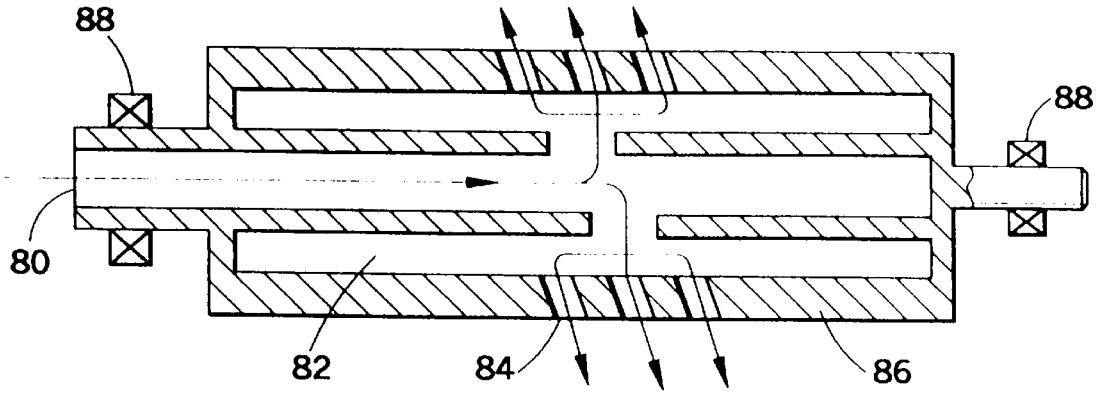
FIG. 7 is an alternative embodiment of a pneumatic roller.

In FIG. 7, yet another alternative roller assembly is shown. Here, the interior portion of the roller assembly also rotates. This allows the entire roller to be formed as one piece and the number of seals between relatively rotating surfaces is decreased. In much the same fashion, the various benefits and advantages described above are achieved.

An inlet 80 communicates with an interior plenum or series of channels 82. Openings 84 are formed in the external surface 86 of the roller and bearings 88 support opposite ends of the roller for rotation. With this arrangement, it is necessary to synchronize the rotation of the roller with the paper position. Thus, although this type of roller may have more limited applications, it could also be used, for example, to revert a sheet of paper for duplex copying as shown in FIGS. 8A–F.

Figure 8A:
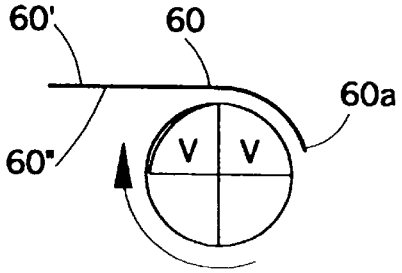
FIGS. 8A–8F are schematic representations of selectively employing vacuum and pressure for paper reversion.
Figure 8B:
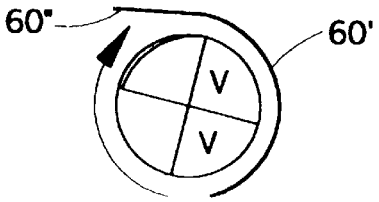
Figure 8C:
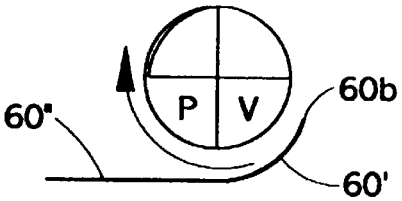
Figure 8D:
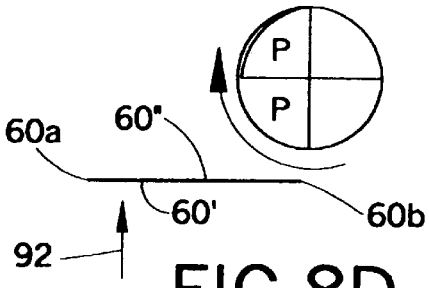

A sheet of paper 60 has a first surface 60' and a second or lower surface 60". The first surface 60' may have already been printed and it is necessary to print on the second surface 60". As a leading edge 60*a* of the paper approaches the roller assembly 10, a circumferentially adjacent pair of quadrants of the roller, and the openings extending through the external surface thereof, are in communication with a source of vacuum (V). This draws the second surface 60" of the sheet onto the roller. The vacuum is maintained to the pair of quadrants as the paper rotates with the roller (FIG. 8B). Once the first quadrant is oriented between the six and nine o'clock positions as shown in FIG. 8C, the source of vacuum to the first quadrant is changed to a source of pressure (P). This releases the sheet from this portion of the roller. A vacuum is maintained, however, in the second quadrant so that the trailing edge 60*b* of the paper is still rotating at the same velocity as that of the roller. Continued clockwise rotation, and the change over of the second quadrant from a source of vacuum to a pressure source P as shown in FIG. 8D, releases the paper from its engagement with the roller. At this stage, the paper has been inverted so that the upper and lower surfaces of the sheet have been reversed from the original position of the paper (FIG. 8A).

Figure 8E:
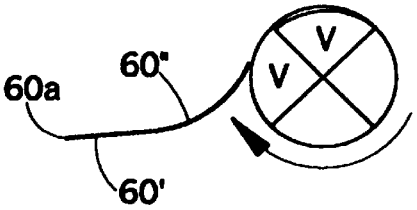
Figure 8F:
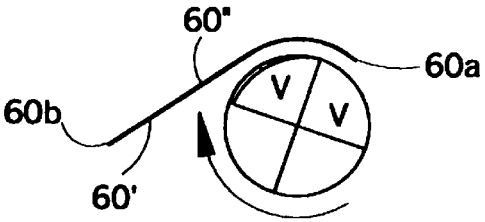

The first and second quadrants are both connected to pressure and an external air jet 92, or a mechanical member, is urged against the first surface 60' of the sheet. This urges the trailing edge 60*b* of the sheet upwardly to a position as shown in FIG. 8E. Since the first and second quadrants have now passed into communication with the vacuum source, the first surface 60' is then brought into engagement with the roller's surface and the paper adopts the rotational velocity of the roller. Continued rotation of the roller in a clockwise direction to the position shown in FIG. 8F completes the reversion process so that the second surface 60" now faces upwardly and the paper sheet can be transported to a downstream workstation such as an imaging station.

The invention has been described with reference to the preferred embodiments. Of course, still other modifications and alterations will be understood by one of ordinary skill in the art. These modifications and alterations are intended to be covered by the appended claims.

Having thus described the invention, it is now claimed:

1. A roller assembly for handling sheet material in a printing apparatus, the roller assembly comprising:

an air source;

a cylindrical roller having an external surface and a rotational axis about which the external surface rotates;

a plenum in the roller communicating with the air source; and openings in the external surface of the roller communicating with the plenum for directing the sheet material in a desired direction relative to the rollers wherein at least one of the openings is oriented in a direction non-perpendicular to the rotational axis of the roller to impart a velocity component in a direction perpendicular to a tangential direction of rotation of the external surface.

2. The roller assembly of claim 1 wherein the openings are oriented in a direction having a component parallel to the rotational axis.

3. The roller assembly of claim 1 wherein the plenum includes first and second portions that are selectively connected to sources of vacuum and pressure for urging the sheet material toward and away from the external surface of the roller.

4. The roller assembly of claim 1 wherein the external surface rotates relative to the plenum.

5. The roller assembly of claim 1 wherein the plenum of the roller also rotates about the rotational axis.

6. A roller assembly for processing sheet material in a printing apparatus, the roller assembly comprising:

a first roller having an external surface with a series of openings communicating with a plenum in the first roller, the plenum being in selective communication with a vacuum source and a pressure source for urging a sheet material toward and away from the external surface, respectively, as the first roller rotates, wherein the first roller is selectively connected to the vacuum source and the pressure source during predetermined rotational positions of the first roller as the sheet material traverses and leaves, respectively, the external surface thereof; and a second roller disposed downstream from the first roller for receiving the sheet material from the first roller, wherein the second roller is selectively connected to the pressure source and the vacuum source during predetermined rotational positions of the second roller as the sheet material approaches and traverses, respectively, the external surface thereof.

7. The roller assembly of claim 6 further comprising a drive member operatively associated with the first and second rollers to rotate the rollers at different velocities.

8. The roller assembly of claim 6 wherein the first roller is used for paper reversion by selectively connecting the openings to the vacuum source during a first predetermined portion of the first roller rotation for urging a first face of the sheet material against the first roller, inverting the sheet material through approximately 180 degrees as the first roller rotates, then connecting at least some of the openings to the pressure source during a second predetermined portion of the first roller rotation to separate the inverted sheet material from the rotating first roller, and subsequently connecting the openings to the vacuum source to urge a second face of the sheet material against the first roller.

9. The roller assembly of claim 8 wherein the first roller rotates in the same direction throughout the paper reversion process.

10. The roller assembly of claim 8 wherein the first roller is connected to the vacuum source during a preselected portion of its rotation and is connected to the pressure source through the remainder of the first roller rotation.

11. The roller assembly of claim 10 wherein only a portion of the circumferential extent of the first roller includes openings.

12. The roller assembly of claim 8 wherein a leading edge of the sheet material is initially received on the first roller and a trailing edge of the same sheet material is received on the first roller once the sheet material has been inverted.

* * * * *